US007387200B2

(12) United States Patent
Borg

(10) Patent No.: US 7,387,200 B2
(45) **Date of Patent: *Jun. 17, 2008**

(54) TANDEM HARNESS FOR TUB-LIKE CONTAINERS

(75) Inventor: Zakary James Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 537 days.

This patent is subject to a terminal disclaimer.

(21) Appl. No.: 11/130,064

(22) Filed: May 16, 2005

(65) Prior Publication Data

US 2006/0254934 A1 Nov. 16, 2006

(51) Int. Cl.
*B65D 75/00* (2006.01)

(52) U.S. Cl. ..... 206/139; 206/150; 206/151; 206/427

(58) Field of Classification Search ..... 206/139, 206/145, 146, 147, 148, 150, 151, 158–160, 206/427, 428; 220/23.2, 23.4, 23.83
See application file for complete search history.

(56) References Cited

U.S. PATENT DOCUMENTS

| | | | | |
|---|---|---|---|---|
| 3,258,288 | A * | 6/1966 | Courter | 294/87.2 |
| 5,188,413 | A * | 2/1993 | Nathan | 294/87.2 |
| 5,221,002 | A * | 6/1993 | Garganese | 206/151 |
| 5,735,562 | A * | 4/1998 | Borg | 294/87.2 |
| 6,715,810 | B2 * | 4/2004 | Borg | 294/87.2 |
| 6,789,828 | B1 * | 9/2004 | Borg | 294/87.2 |

* cited by examiner

*Primary Examiner*—Taghi T. Arani
*Assistant Examiner*—Jose S Stephens, III
(74) *Attorney, Agent, or Firm*—Chernoff Vilhauer McClung & Stenzel LLP

(57) ABSTRACT

A harness for holding two tub-like containers together is disclosed.

10 Claims, 2 Drawing Sheets

TANDEM HARNESS FOR TUB-LIKE CONTAINERS

BACKGROUND OF THE INVENTION

The use of carrier straps for bottles or jugs is known. See, for example, U.S. Pat. Nos. 5,306,060 and 6,394,517. Similarly, the use of resilient webs for harnessing together six-packs of beverages and tub-like containers is known. The use of shrink-wrap or paper trays to band together multiple tub-type containers is also known. However, all such devices have inherent drawbacks with respect to holding tub containers together in that the tub containers are difficult to extract from them and often loosen during shipment or with changes in temperature.

A tandem harness for tub-like containers is disclosed in commonly owned U.S. Pat. No. 6,808,070, comprising two discontinuous circular resilient bands joined together, with the discontinuities being provided with catch assemblies. The impetus for the present invention is the discovery that tub-like containers attached by resilient bands having no discontinuities therein provide a more secure and stable attachment relative to bands with discontinuities.

BRIEF SUMMARY OF THE INVENTION

According to the present invention there is provided a tandem harness for two tub-like containers, comprising two circular resilient bands joined by an intermediate web, each of the bands having at least two offset catch assembly integral with the bands, wherein each catch assembly comprises (i) two legs joining the bands at approximately right angles, (ii) an inverted U-shaped member attached to the two legs, and (iii) a catch for engaging the upper periphery of the containers.

The foregoing and other objectives, features, and advantages of the invention will be more readily understood upon consideration of the following detailed description of the invention taken in conjunction with the accompanying drawings.

BRIEF DESCRIPTION OF THE VIEWS OF THE SEVERAL DRAWINGS

DETAILED DESCRIPTION OF PREFERRED EMBODIMENTS

Figure 1:
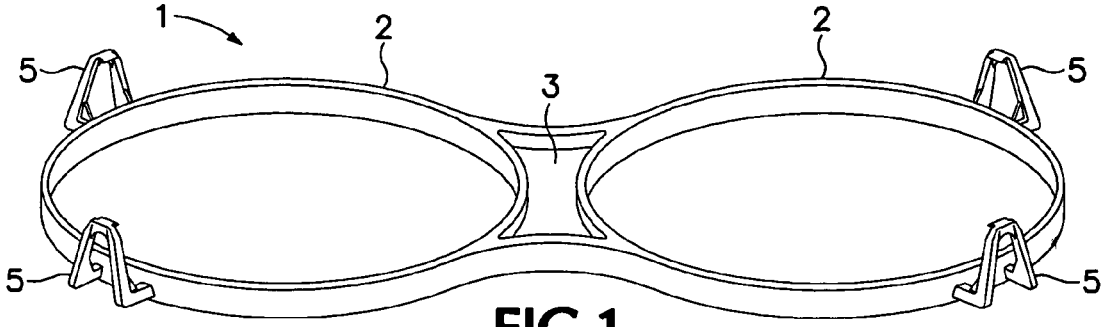
FIG. 1 is a perspective view of an exemplary embodiment of the tub harness of the invention.
Figure 2:
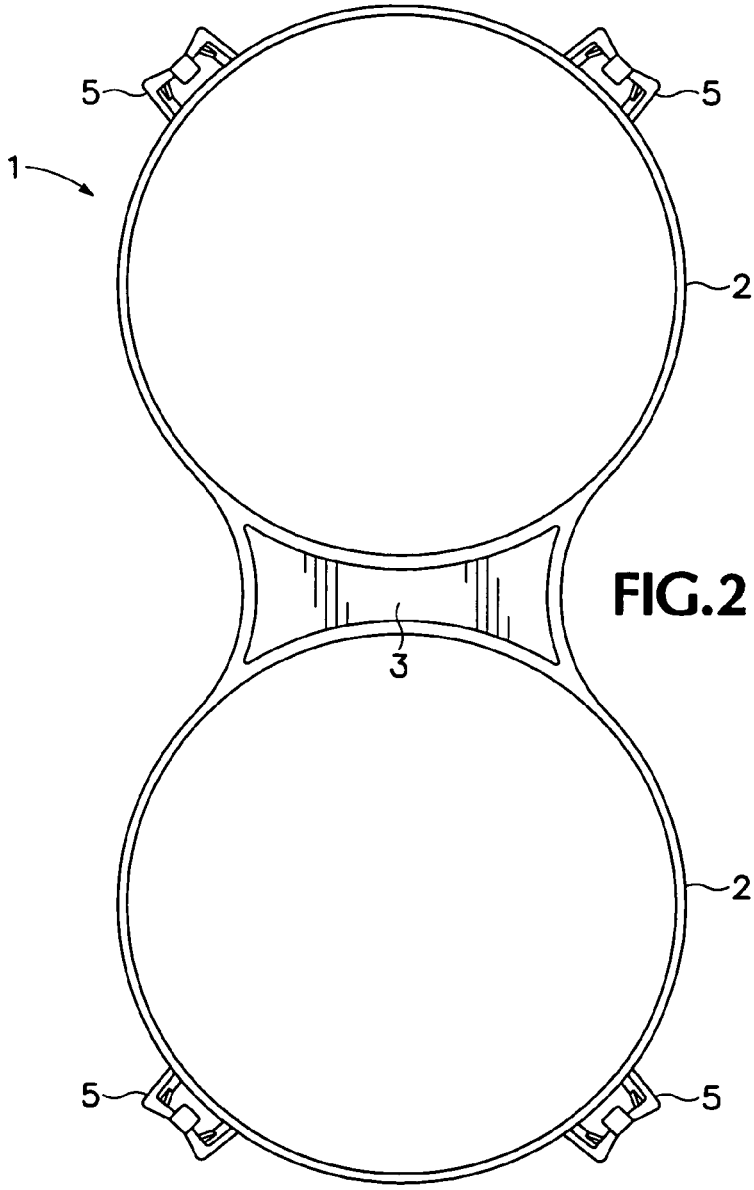
FIG. 2 is a plan view of the tub harness shown in FIG. 1.
Figure 3:
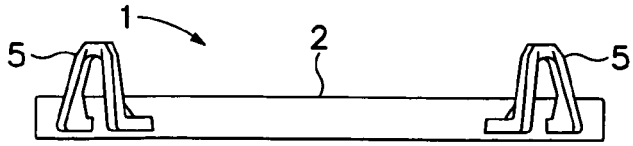
FIG. 3 is an end view of the tub harness shown in FIG. 1.

Referring to the drawings, where the same numerals refer to like elements, there are shown in FIGS. 1-5 a tandem harness 1 for two tub-like containers typically found in the food industry. The harness comprises two generally circular bands 2 preferably formed from a polymer such as a polyolefin, e.g., recyclable high density polyethylene, the polymer imparting a degree of resiliency. The two bands are joined by a web 3, and have at least two offset catch assemblies 5 that are integral with the bands 2, each catch assembly comprising two legs 6 joining the bands at approximately right angles, an inverted U-shaped member 7 attached to legs 6, and a catch 8 for engaging the upper peripheral rim of the tubs.

Figure 5:
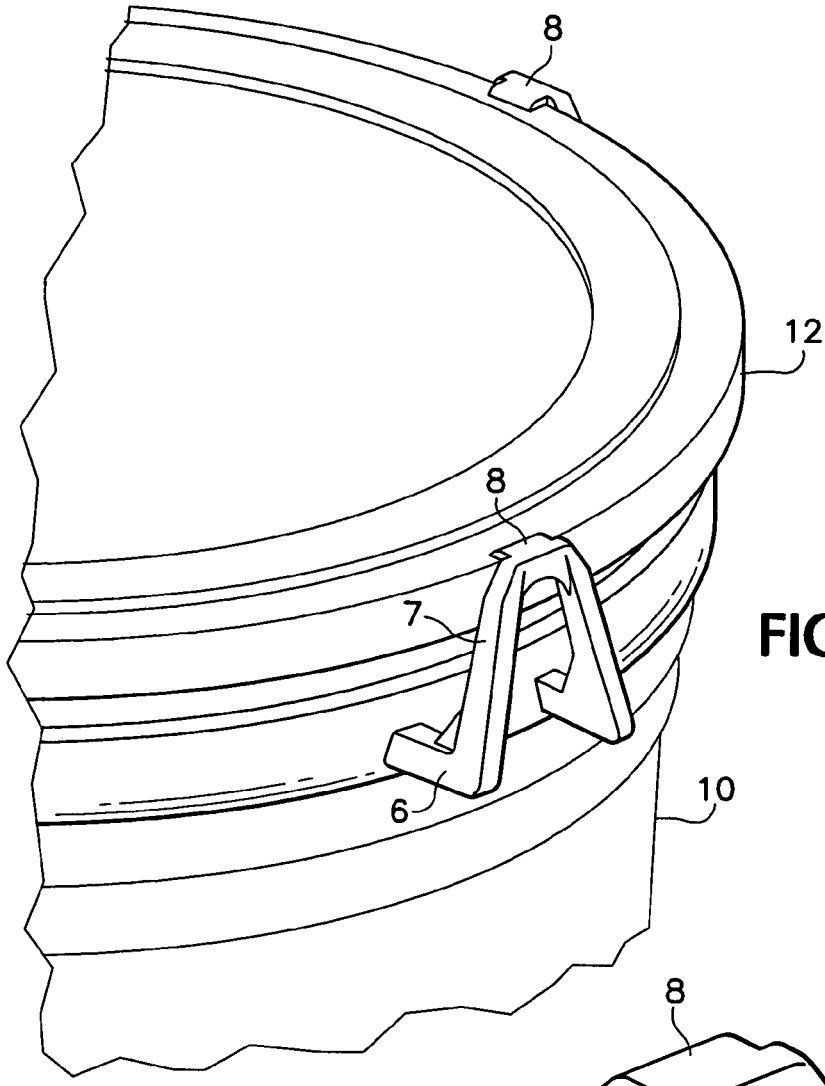
FIG. 5 is a perspective view of the tub harness of FIG. 1 in engagement with a tub having a lid.
Figure 4:
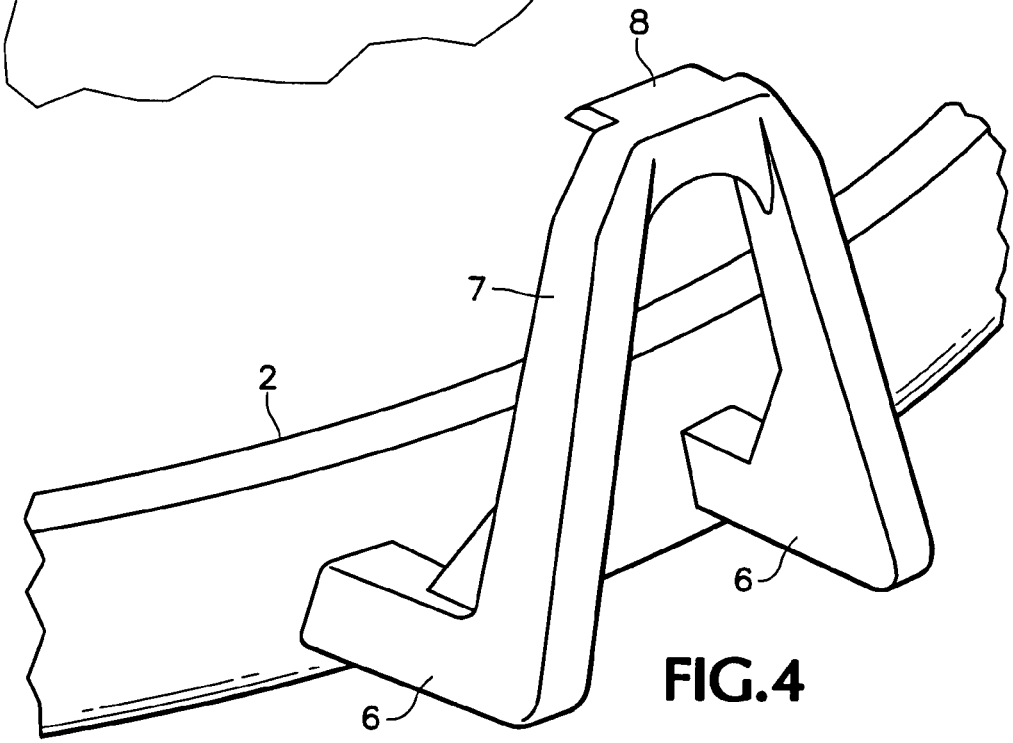
FIG. 4 is a close-up perspective view of the catch assembly of the tub harness shown in FIG. 1.

In a preferred embodiment depicted in FIG. 5, tub container 10 has a lid 12, which is engaged along its periphery by an upper portion of inverted U-shaped member 7 and on its surface by catch 8. Preferably inverted U-shaped member 7 is oriented at about 90° relative to legs 6, and is tapered slightly toward catch 8. Catch 8 is also preferably oriented at about 90° relative to inverted U-shaped member 7.

To install the tandem harness on a pair of tub containers with lids, one of the bands 2 is slipped over the bottom of the tub container 10 and raised until the band is just below the lid 12, followed by slightly splaying catch assemblies 5 outwardly until catches 8 engage the top of lid 12 by virtue of their design and the resiliency of the material from which the entire harness is made, then releasing them. The procedure is repeated with the second band over a second tub, thereby securing the two tubs together. To release the harness, the catch assembly 5 is again simply splayed slightly outwardly to disengage catch 8 from the lids, and the band 2 is slipped downwardly off the tub.

When tub containers are secured together by the harness, they are more stable in shipping boxes, on the store shelf or in a grocery bag. The harnesses of the invention have such a low profile above the tub lid that stacking of the tub containers two-by-two is readily accomplished. In addition, the design readily permits stacking of the harnesses themselves, thereby facilitating automated manufacture of them and easing handling and shipping in large quantities.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

I claim:

1. A tandem harness for two tub-like containers, comprising two circular resilient bands joined by an intermediate web, each of said bands having at least two offset catch assemblies integral with said bands, wherein each catch assembly comprises (i) two legs joining said bands at approximately right angles, (ii) an inverted U-shaped member attached to said two legs, and (iii) a catch for engaging the upper periphery of said containers.

2. The harness of claim 1 wherein said containers have lids and said catch engages said lids.

3. The harness of claim 2 wherein said inverted U-shaped member is oriented at about 90° relative to said two legs.

4. The harness of claim 3 wherein said inverted U-shaped member is tapered.

5. The harness of claim 4 wherein said catch is oriented at about 90° relative to said inverted U-shaped member.

6. The harness of claim 5 wherein said catch is adapted to snugly engage said lids.

7. The harness of claim 6 wherein said catch is adapted to snugly engage the top surface of said lids.

8. The harness of any of claims 1-7 made from a polymer.

9. The harness of claim 8 wherein said polymer is high density polyethylene.

10. The harness of claim 9 wherein said high density polyethylene is recyclable.

* * * * *

UNITED STATES PATENT AND TRADEMARK OFFICE

CERTIFICATE OF CORRECTION

PATENT NO. : 7,387,200 B2
APPLICATION NO. : 11/130064
DATED : June 17, 2008
INVENTOR(S) : Zakary James Borg It is certified that error appears in the above-identified patent and that said Letters Patent is hereby corrected as shown below:

Column 2, line 33 – Change "excluding equivalence of" to --excluding equivalents of--

Signed and Sealed this

Twenty-eighth Day of October, 2008

JON W. DUDAS
*Director of the United States Patent and Trademark Office*